US007231697B2

(12) United States Patent
Takamatsu et al.

(10) Patent No.: US 7,231,697 B2
(45) Date of Patent: Jun. 19, 2007

(54) END STOP FOR SLIDE FASTENER AND SLIDE FASTENER HAVING THE SAME

(75) Inventors: Satoshi Takamatsu, Toyama-ken (JP); Masaaki Fuda, Toyama-ken (JP); Yukio Taga, Toyama-ken (JP)

(73) Assignee: YKK Corporation, Tokyo (JP)

( * ) Notice: Subject to any disclaimer, the term of this patent is extended or adjusted under 35 U.S.C. 154(b) by 102 days.

(21) Appl. No.: 10/518,150

(22) PCT Filed: Jun. 6, 2003

(86) PCT No.: PCT/JP03/07188

§ 371 (c)(1),
(2), (4) Date: Dec. 17, 2004

(87) PCT Pub. No.: WO04/000062

PCT Pub. Date: Dec. 31, 2003

(65) Prior Publication Data

US 2005/0257350 A1 Nov. 24, 2005

(30) Foreign Application Priority Data

Jun. 20, 2002 (JP) ..... 2002-179532

(51) Int. Cl.
*A44B 19/36* (2006.01)

(52) U.S. Cl. ..... 24/436

(58) Field of Classification Search ..... 24/398, 24/394, 434, 436

See application file for complete search history.

(56) References Cited

U.S. PATENT DOCUMENTS 2,483,703 A 10/1949 Legat
3,456,306 A * 7/1969 Heimberger ..... 24/397
3,748,709 A 7/1973 Potin
3,813,459 A 5/1974 Potin
4,045,845 A 9/1977 Kando
4,091,509 A 5/1978 MacFee
4,267,621 A 5/1981 Akashi
5,417,249 A * 5/1995 Kato ..... 24/393
6,427,294 B1 * 8/2002 Shibaike et al. ..... 24/398

FOREIGN PATENT DOCUMENTS

CA 1021139 11/1977

(Continued)

*Primary Examiner*—Robert J. Sandy
(74) *Attorney, Agent, or Firm*—Everest Intellectual Property Law Group; Michael S. Leonard

(57) ABSTRACT

A synthetic-resin-made linear slide fastener has a top end stop and a bottom end stop. A coil-like or zigzag-like linear fastener element row (3) of synthetic resin is mounted on a side edge of a fastener tape (4), and then a rod-like body (6) is inserted into a coupling space portion (13) in a rear side of coupling heads (10) of plural fastener elements at a terminal end of the fastener element row (3) and attached thereto. Alternatively, a curved sheet-like body (7) is attached such that the sheet-like body surrounds and covers surfaces of the coupling heads (10), leg portions (11) and connecting portions (12) and thereafter, the rod-like body or the sheet-like body is fused with fastener elements (3) by ultrasonic welding so as to form an end stop (14) as the top end stop (15) or the bottom stop end (16).

9 Claims, 18 Drawing Sheets

FOREIGN PATENT DOCUMENTS

| | | |
|---|---|---|
| DE | 2039191 | 2/1971 |
| DE | 2304314 | 8/1974 |
| EP | 0110346 | 6/1984 |
| EP | 0237068 | 9/1987 |
| EP | 1048237 | 11/2000 |
| FR | 2239963 | 3/1975 |
| GB | 782877 | 9/1957 |
| GB | 1377053 | 12/1974 |
| GB | 2033957 | 5/1980 |
| JP | 44-1042 | 1/1969 |
| JP | 51-4823 | 2/1976 |
| JP | 51-49604 | 4/1976 |
| JP | 54-61702 | 4/1979 |
| JP | 56-51773 | 12/1981 |
| JP | 59-46117 | 3/1984 |
| JP | 59-25221 | 7/1984 |
| JP | 2000-312604 | 11/2000 |
| JP | 2001-211913 | 8/2001 |

* cited by examiner

END STOP FOR SLIDE FASTENER AND SLIDE FASTENER HAVING THE SAME

TECHNICAL FIELD

The present invention relates to end stops, i.e., a top end stop or a bottom end stop for a slide fastener and a hidden slide fastener in which coil-type or zigzag-type linear fastener elements of synthetic resin are mounted on a side edge of a fastener tape and relates to a slide fastener having the same end stops.

BACKGROUND ART

Conventionally, various types of end stops have been proposed about a top end stop and a bottom end stop of a coil-type or zigzag-type linear slide fastener and hidden slide fastener made of synthetic resin. According to a stop end 22 disclosed in Japanese Utility Model Application Publication No. 56-51773, a synthetic resin piece 21 having a circular section is formed on a tape-side rear face of heads 10 of plural elements at a terminal end of a linear fastener element row 3 such that it is capable of being fused, as shown in FIG. 26, and an end portion of the synthetic resin piece 21 located at the terminal end of the element row 3 is bent to a surface so as to produce a bent portion 21*a*. The end face of the bent portion 21*a* is formed lower than a surface of the elements and then, the bent portion 21*a* is fused with a coupling face formed in a dented state in a side face of a head 10 of an element at a terminal end of the element row.

In addition, according to a stop end 23 disclosed in Japanese Utility Model Application Publication No. 59-25221, as shown in FIG. 27, a film piece 25 made of synthetic resin is placed on and fused with a top side of plural elements of an liner fastener element row 3 made of synthetic resin, and a film piece 25 above a sewing yarn 24 which sews leg portions 11 of the elements is formed thicker than an other portion so as to provide a convex row 25*a* and then, the sewing yarn 24 is protected by this convex row 25*a* while the other portion of the film piece 25 except for the convex row 25*a* adheres up to a rear face of the elements so as to embrace it.

Further, according to a stop end 26 disclosed in Japanese Utility Model Application Publication No. 51-4823, as shown in FIG. 28, a metallic pin 28 with a head is inserted into a gap portion 27 existing at a rear side of plural element heads 10 in conditions in which coil type or zigzag type linear fastener element rows 3 made of synthetic resin are coupled with each other, thereby fixing right and left elements.

In case of the bottom end stop 22 shown in FIG. 26, the synthetic resin piece 21 is fused with a bottom face of the heads 10 of the linear fastener element row 3 with ultrasonic welding under a pressure and an end of the synthetic resin piece is bent to a surface side of the elements and fused with the side face of the head 10 of the element. For the reason, the welding processing of the synthetic resin 21 is extremely troublesome, so that the end stop cannot be produced at a cheap price. Because the synthetic resin piece 21 is fused with the surface of the element, it may peel off during usage.

In case of the end stop shown in FIG. 27, ultrasonic processing is carried out so as to reform the surface of a top end stop 36 into a convex shape by placing the synthetic resin film piece 25 on the top surface of plural linear fastener elements. In this case, there is a fear that burrs may occur at an end portion of the film piece 25, so that there is a problem in the safety. In case of the bottom end stop 26 shown in FIG. 28, the metallic pin with the head is just inserted into the linear fastener element rows 3 made of synthetic resin. Therefore, its fixing is instable, and if an unreasonable force is applied during use, the pin 28 may slip out.

The present invention has been achieved considering the above-described problems and a first object of the invention is to provide an end stop for a slide fastener having a rigid structure and an excellent quality and which can be manufactured at a cheap price, and another object of the invention is to provide an end stop for a slide fastener which can be manufactured easily and exert an effective stop function. Still another object of the invention is to provide a slide fastener having the aforementioned end stop comprised of an ordinary type or hidden type fastener chain which undergoes special patterning or processing at its fastener tape.

DISCLOSURE OF THE INVENTION

To achieve the aforementioned objects, a first basic configuration of the present invention is an end stop for a slide fastener which is formed by fusing a synthetic resin piece attached over plural fastener elements located at a terminal end side of a synthetic resin made linear fastener element row mounted on a side edge of an ordinary type or hidden type slide fastener tape.

In the end stop of the invention, the synthetic resin made linear fastener element row is mounted on the side edge of the fastener tape and then a synthetic resin piece is attached over plural fastener elements located at a terminal end of the fastener element row and fused so as to form the end stop for a slider. With such a configuration, because the synthetic resin piece is fused after it is attached to the linear fastener elements, the synthetic resin piece can be held at a predetermined position accurately with respect to the linear fastener elements and further fused together effectively.

Further, as the synthetic resin piece, a rod-like body or a curved sheet-like body may be used. By using such a rod-like body or a curved sheet-like body, the synthetic resin piece can be attached easily and accurately, and moreover, the synthetic resin piece can be produced easily.

Because the rod-like body is inserted into a coupling space portion located in a rear side of coupling heads in the linear fastener elements and fused therein, generation of burrs on the surface of the linear fastener elements is suppressed, in addition to the above-described effects, so that an excellent quality end stop can be formed.

Furthermore, the rod-like body is crushed and fused together with the coupling heads of the linear fastener elements from the front and rear surfaces. According to such fusing, the end stop, which stops the slider securely at a terminal end of the linear fastener element row and prevents the slider from slipping out, can be formed.

The sheet-like body is fused together to cover the coupling heads, leg portions and connecting portions of the linear fastener elements. According to such measure, generation of burrs on the surface of the linear fastener elements can be prevented and an excellent quality end stop can be formed.

According to the present invention, the rod-like body is disposed inside the linear fastener element row, the linear fastener element row being in a non-engaged state, and fused so as to form a top end stop. In this case, the rod-like body can be inserted into the inside of the linear fastener element row easily in a fastener stringer in which its fastener elements are not coupled, so as to form the top end stop easily.

Likewise, in the case of the sheet-like body, the sheet-like body is disposed on the surface of the linear fastener element row, the linear fastener element row being in a non-coupled state, and fused together so as to form a top end stop. In this case, the sheet-like body can be easily applied to a fastener stringer in which its fastener elements are not coupled, so as to form a top end stop easily.

Further, the rod-like body is disposed inside each of the linear fastener element rows in a coupled state and fused together so as to form a bottom stop end. Consequently, the rod-like body can be applied to a fastener chain easily, in which its fastener elements are coupled, so as to form a bottom end stop easily.

The bottom end stop can be formed by using the sheet-like body also. That is, the sheet-like body is disposed on the surface of each of the linear fastener element rows in a coupled state and fused together so as to form a bottom end stop. Consequently, the sheet-like body can be easily applied to a fastener chain, in which fastener elements are coupled, so as to form a bottom end stop easily.

A second basic configuration of the present invention is a slider fastener having the above-described end stop and which is characterized in that the fastener tape in a fastener chain undergoes special treatment, that is, patterning by ink jet and/or waterproof processing. Such a configuration can prevent the fastener tape from being damaged by mounting the end stop to the fastener tape, thereby finishing a slide fastener having an excellent appearance.

BEST MODE FOR CARRYING OUT THE INVENTION

Figure 1:
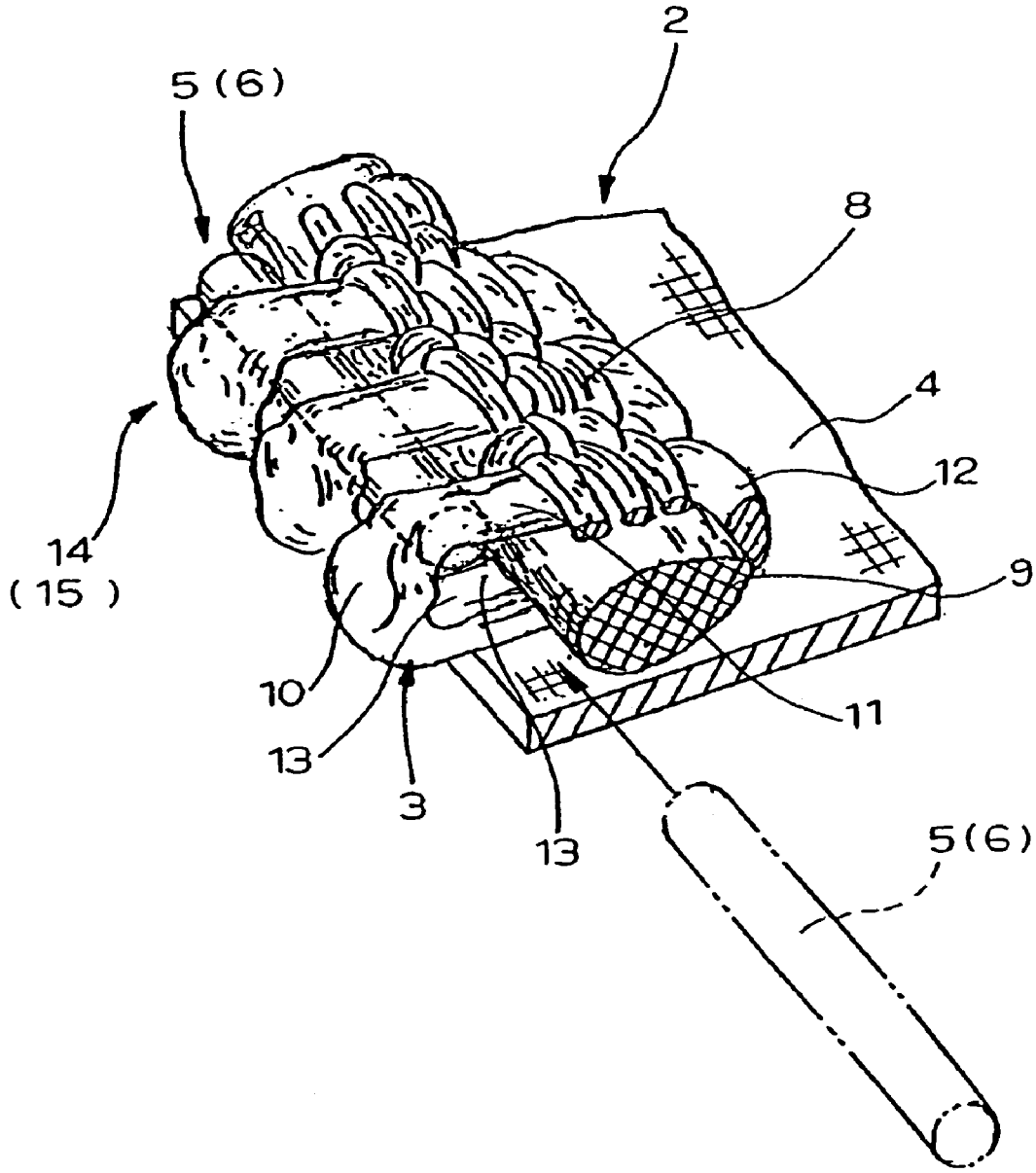
FIG. 1 is a perspective view of a top end stop using a bar-like body for an ordinary type slide fastener.

Hereinafter, an end stop for a slide fastener of the present invention will be described specifically with reference to the accompanying drawings.

As for the slide fastener of the present invention, a mono-filament of synthetic resin such as polyamide or polyester is wound into a coil-like shape or bent into a zigzag form so as to produce a linear fastener element row 3. This linear fastener element row 3 is sewed on a side edge of a fastener tape with a sewing yarn 8 or mounted by weaving or knitting in the fastener tape, so as to finish an ordinary type slide fastener or a hidden type slide fastener. The coil-like or zigzag-like linear fastener elements 3 are respectively comprised of a coupling head 10, upper and lower leg portions 11, a connecting portion 12 and a coupling space portion 13. A core thread 9 is placed through the inside of the linear fastener element row 3, so that it is intended to mount the fastener element row 3 onto a fastener tape 4 or stabilize the engagement operation of the fastener elements 3.

Figure 2:
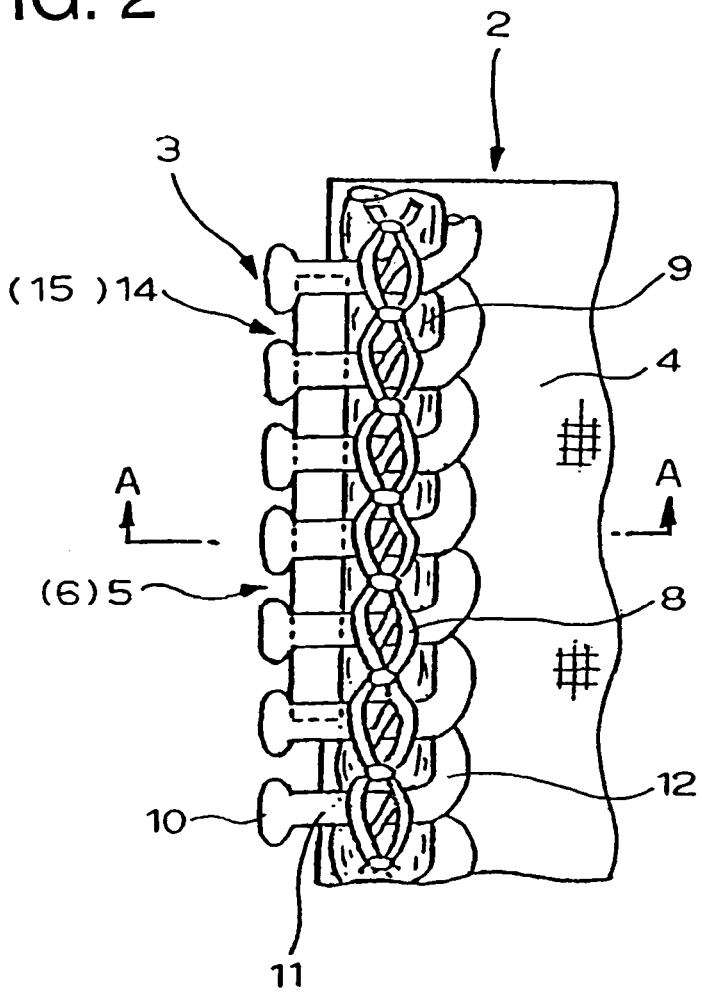
FIG. 2 is a front view of the same top end stop.
Figure 3:
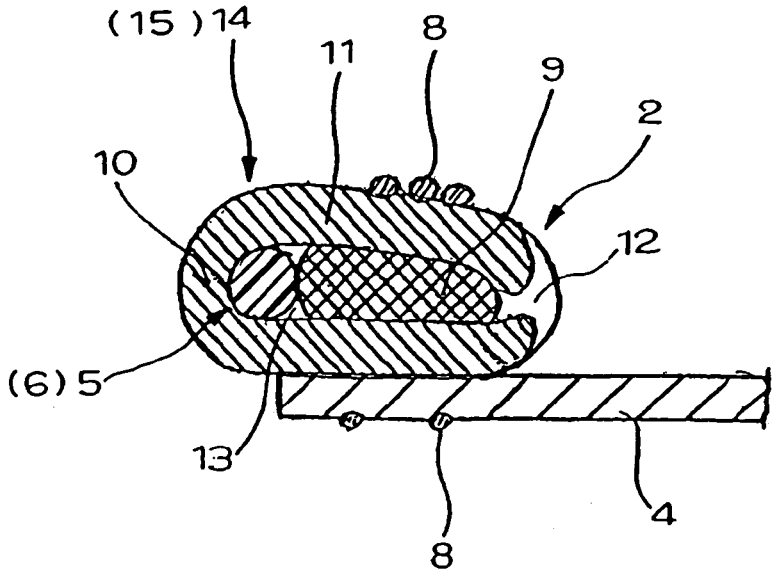
FIG. 3 is a sectional view taken along the line A—A of the same top end stop.

The present invention concerns an end stop 14, i.e., a top end stop 15 and a bottom end stop 16, which is applicable to both an ordinary type slide fastener and a hidden type slide fastener formed in the above-described manner. If the end stop 14 for the top end stop 15 in the ordinary type slide fastener shown in FIGS. 1 to 3 will be described, an element in which the core thread 9 is passed through the coil-like linear fastener element row 3 is sewed on the side edge of the fastener tape 4 such that the coupling head 10 is projected from the side edge so as to produce a fastener stringer 2. A synthetic resin piece 5, which is formed of the same kind of thermoplastic resin such as polyamide or polyester as the fastener element 3 or resin having a low melting point into a round rod-like body 6, is passed through the coupling space portion 13 formed in the rear side of the coupling heads 10 of plural fastener elements 3 existing at a terminal end of the fastener stringer 2, and the rod-like body 6 is held within the coupling space portion 13 surrounded by the fastener elements 3 and the core thread 9 and added thereto.

The rod-like body 6 added to the coupling space portion 13 is fused with the fastener element 3 and the core thread 9 by ultrasonic welding. Therefore, the coupling space portion 13 existing in the rear side of the coupling heads 10 of the fastener elements 3 is closed by the fused synthetic resin piece 5, so that the coupling heads 10 of mating fastener elements 3 are blocked from invading into the coupling space portion 13 for engagement. As a result, it exerts a stop function of the end stop as the top end stop 15 for preventing a slider from slipping out of the fastener chain 1.

In the meantime, because the rod-like body 6 of the synthetic resin piece 5 is fused within the coil-like fastener elements 3, no burr is generated on the surface of the fastener elements 3, so that a good-quality top end stop 15 is finished. The size and shape of the rod-like body 6 for use is selected appropriately depending on the size of the applied fastener elements 3 and the shape of the coupling space portion 13.

Figure 4:
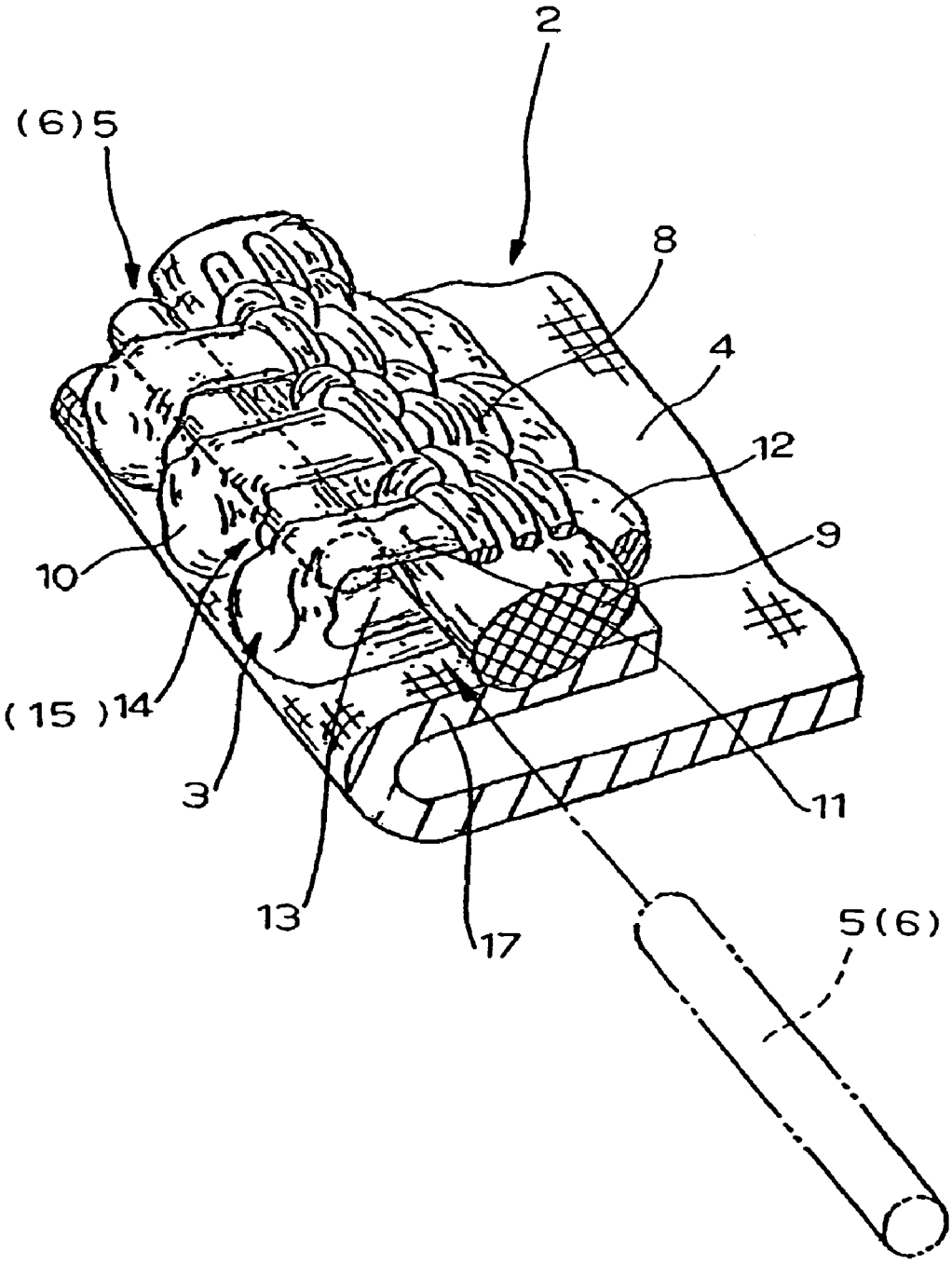
FIG. 4 is a perspective view of a top end stop using a bar-like body for a hidden type slide fastener.
Figure 5:
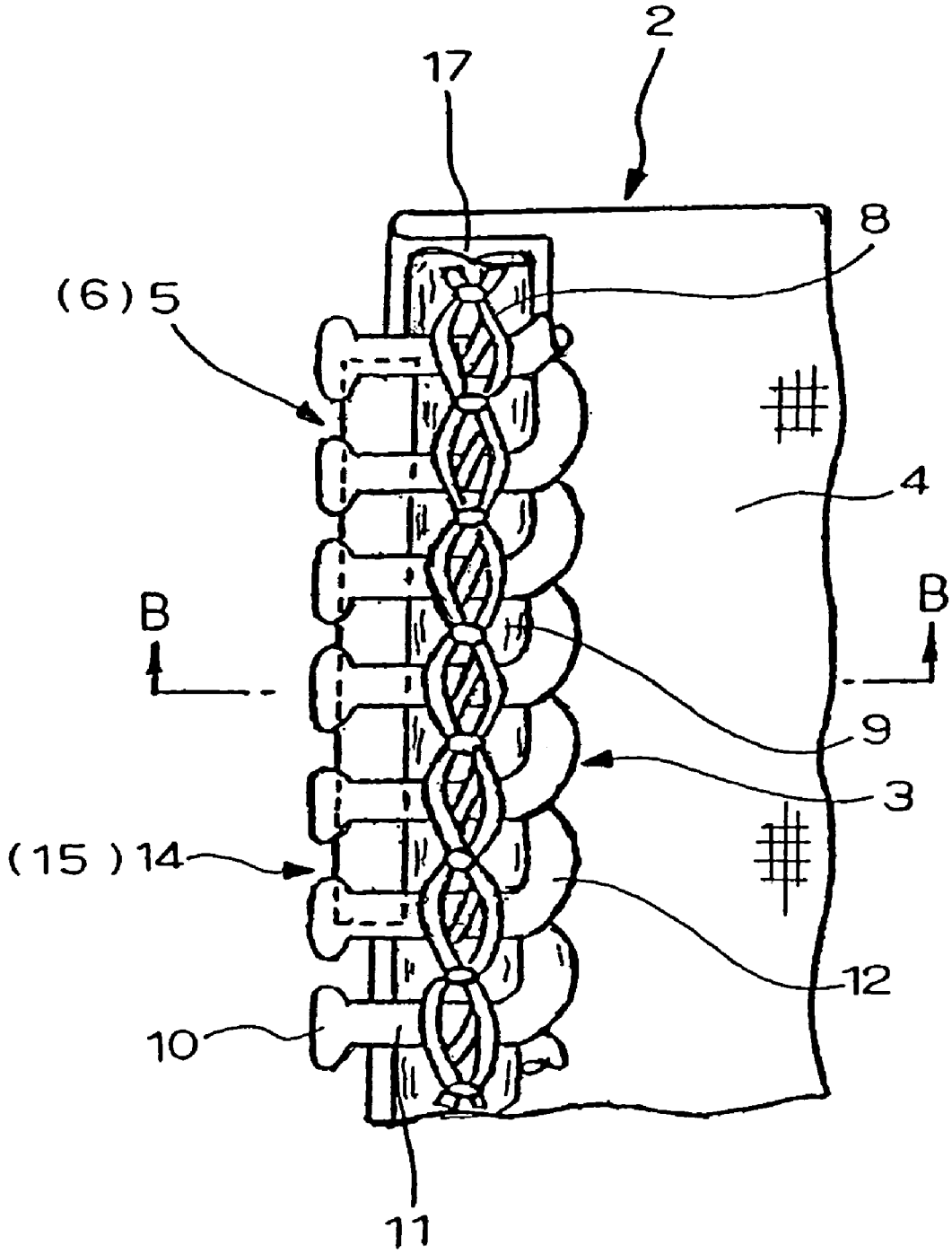
FIG. 5 is a front view of the same top end stop.
Figure 6:
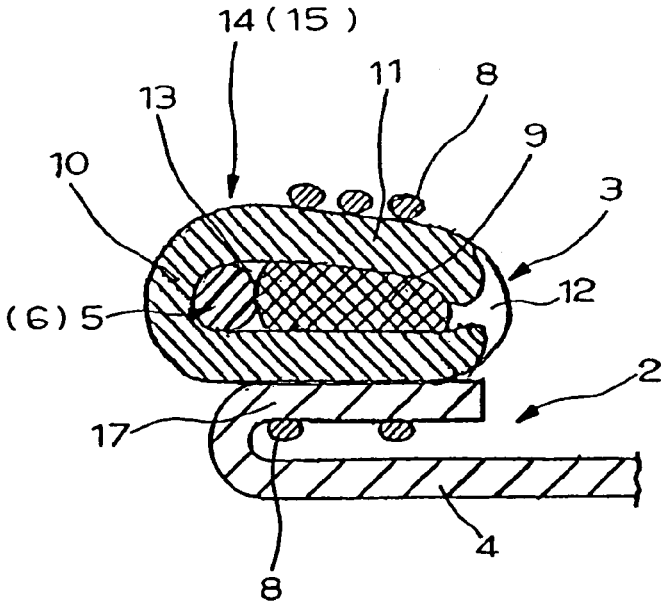
FIG. 6 is a sectional view taken along the line B—B of the same top end stop.

The end stop 14 shown in FIGS. 4 to 6 is a top end stop 15 for a hidden type slide fastener. The element in which the core thread 9 is placed through the coil-like linear fastener element row 3 is sewed onto the fastener tape 4 through the leg portions 11 such that the connecting portions 12 of the fastener elements 3 are located on a side edge of the fastener tape 4. Then, the fastener tape 4 is folded back near the sewing yarn 8 existing inside the fastener tape 4 so as to form a state in which the coupling heads 10 project from a folded-back portion 17. Consequently, the hidden type fastener stringer 2 is completed. Then, the rod-like body 6 of the synthetic resin piece 5 is inserted into the coupling space portion 13 existing in the rear side of the coupling heads 10 of plural fastener elements 3 existing at the terminal end of the fastener stringer 2 and attached thereto.

The rod-like body 6 attached to the coupling space portion 13 is fused to the fastener elements 3 and the core thread 9 by ultrasonic welding. Thus, the coupling space portion 13 existing in the rear side of the coupling head 10 is closed by the synthetic resin piece 5 like the ordinary type fastener element row 3, so that the coupling heads 10 of the mating fastener elements 3 are blocked from their engagement. As a result, it exerts a stop function of the end stop as the top end stop 15 for the hidden type slide fastener.

Particularly, because the fastener element row 3 of the hidden type slide fastener exists in the rear side of the fastener stringer 2, naturally, the top end stop 15 is located in the rear side also. If there is burr on the top end stop 15, it may often make a direct contact with the skin of the neck or the like and hence, it is necessary to block generation of such burr completely. As for this point in the top end stop 15 of the invention, because the rod-like body 6 as the synthetic resin piece 5 is passed through the inside of the fastener element row 3 and fused therein, no burr is generated on the surface of the fastener element row 3 and as a result, a good-quality hidden slide fastener can be finished. Further, because the external shape of the end stop 14 does not change, when the hidden type slide fastener is sewed on clothes, there never occurs such an inconvenience that the end stop 14 may make contact with a sewing machine foot guide.

Figure 7:
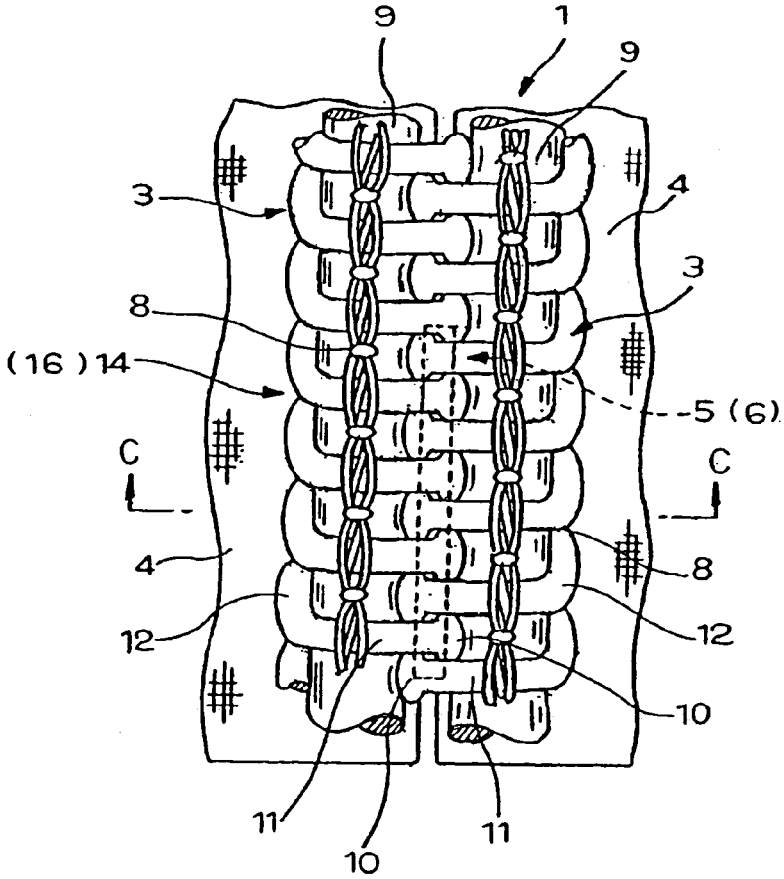
FIG. 7 is a front view of a bottom end stop using a bar-like body for the ordinary type slide fastener.
Figure 8:
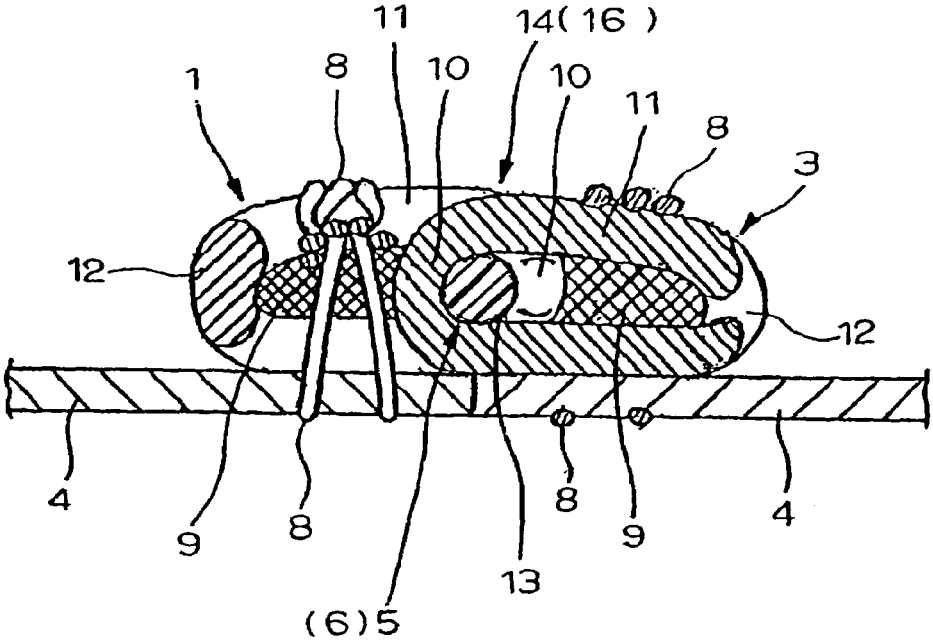
FIG. 8 is a sectional view taken along the line C—C of the same bottom end stop.

As for the end stop 14 in the ordinary type slide fastener shown in FIGS. 7 and 8, in the fastener chain 1 in which the coil-like fastener element rows 3 mounted on side edges of right and left fastener tapes 4 are coupled with each other, the round rod-like body 6 formed of the synthetic resin piece 5 is inserted through the coupling space portion 13 existing in the rear side of the coupling heads 10 of plural fastener elements 3 at the terminal end of the fastener chain 1, and held and attached thereto. After attached to the coupling space portion 13, the rod-like body 6 is fused with and fixed to the fastener elements 3 and the core thread 9 by ultrasonic welding, so that the end stop 14 as the bottom end stop 16 for the ordinary type slide fastener is completed.

Figure 9:
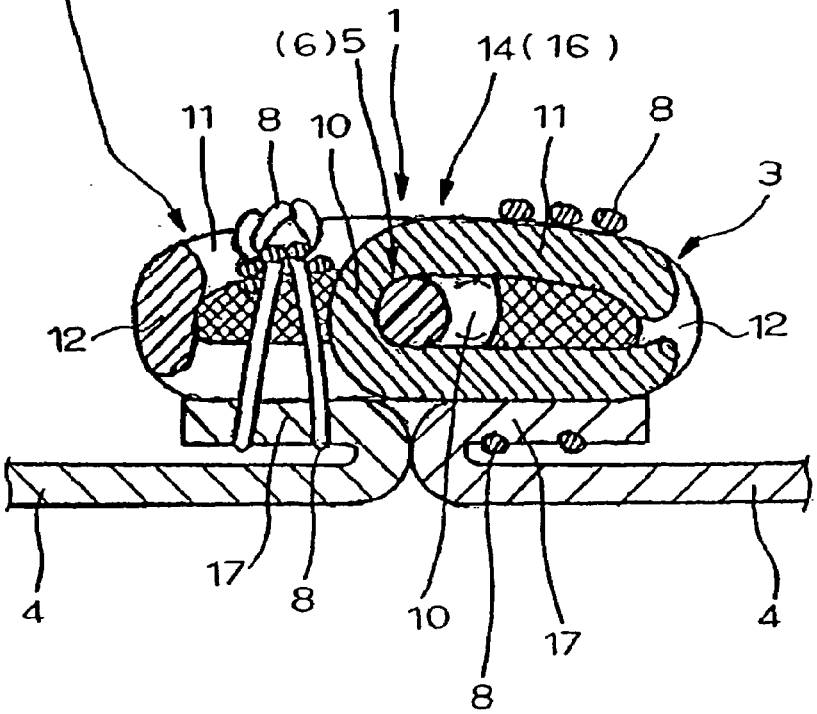
FIG. 9 is a sectional view of the bottom end stop using a bar-like body for the hidden type slide fastener.

As for the end stop 14 in the hidden type slide fastener shown in FIG. 9, in the fastener chain 1 in which the coil-like linear fastener element rows 3 mounted on the folded-back portion 17 of the right and left fastener tapes 4 are coupled with each other, the rod-like body 6 as the synthetic resin piece 5 is inserted into the coupling space portion 13 existing in the rear side of the coupling heads 10 of plural fastener elements 3 at the terminal end of the fastener chain 1, and held in and attached to the coupling space portion 13. Thereafter, the rod-like body 6 is fused with the fastener elements 3 and the core thread 9 by ultrasonic welding and fixed thereto, so as to complete the end stop 14 as the bottom end stop 16 for the hidden type slide fastener.

Figure 10:
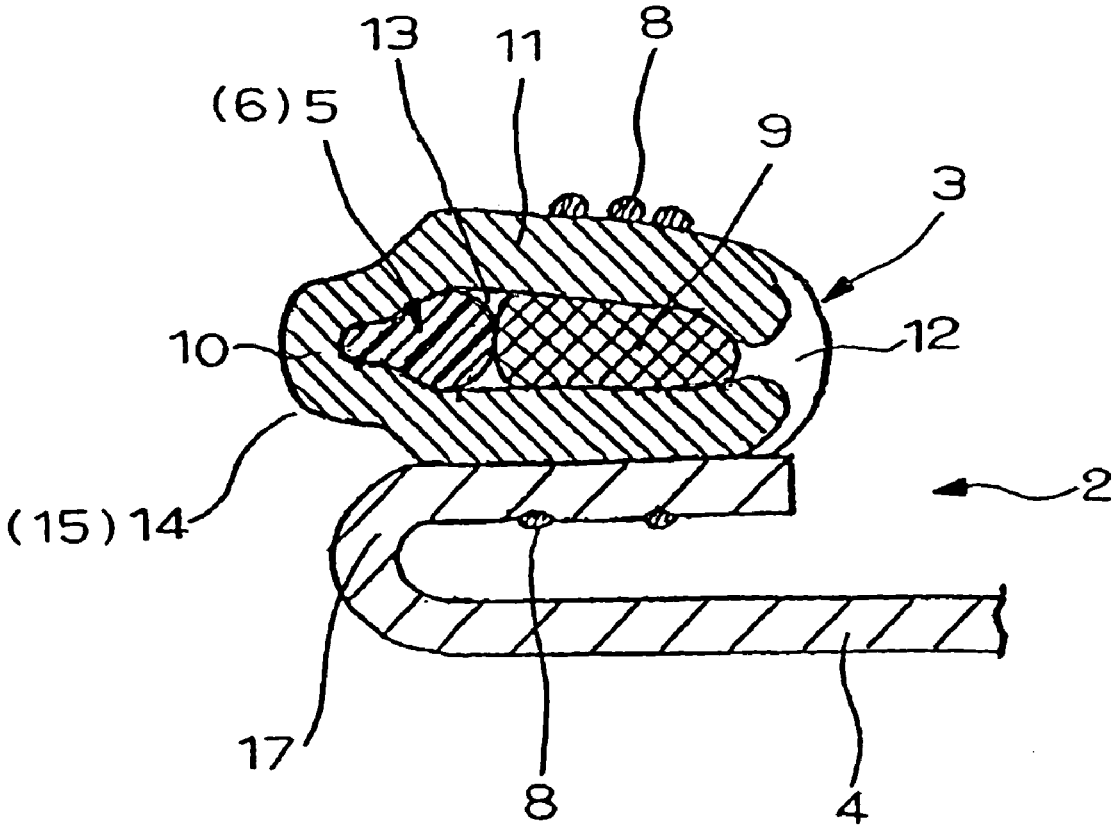
FIG. 10 is a sectional view of a crushed top end stop of the hidden type slide fastener.

As for the end stop 14 for the hidden type slide fastener shown in FIG. 10, the rod-like body 6 of the synthetic resin piece 5, which is inserted into the coupling space portion 13 existing in the rear side of the coupling heads 10 of the fastener element row 3 mounted on the folded-back portion 17 of the fastener tape 4 in the fastener stringer 2 and held in and attached to the coupling space portion 13, is fused with the fastener element row 3 and the core thread 9 by ultrasonic welding. At the same time, the coupling heads 10 of the fastener element row 3 are pressed from top and bottom, that is, form the front and rear surfaces so as to crush and fix the rod-like body 6 to form the top end stop 15. By expanding the lateral width of the end stop 14 in the fastener element row 3, the stop function of the slider is established clearly. In the meantime, the end stop 14 of this type can be applied to the bottom end stop 16 of the fastener chain 1 and can be applied to the ordinary type slide fastener also.

Although, in the end stops for the slide fasteners in the above-described respective embodiments, the rod-like body 6 is employed as the synthetic resin piece 5 which is a base material constituting the end stop 14, as the synthetic resin piece 5 used for the end stops 14 for the slide fasteners of the respective embodiments which will be described below, a synthetic resin piece 5 which is formed into the curved sheet-like body 7 is used, the sheet-like body 7 being made by such matter that a tube molded from thermoplastic resin such as polyamide or polyester, or resin having a low melting point is cut out along its one side and opened up.

Figure 11:
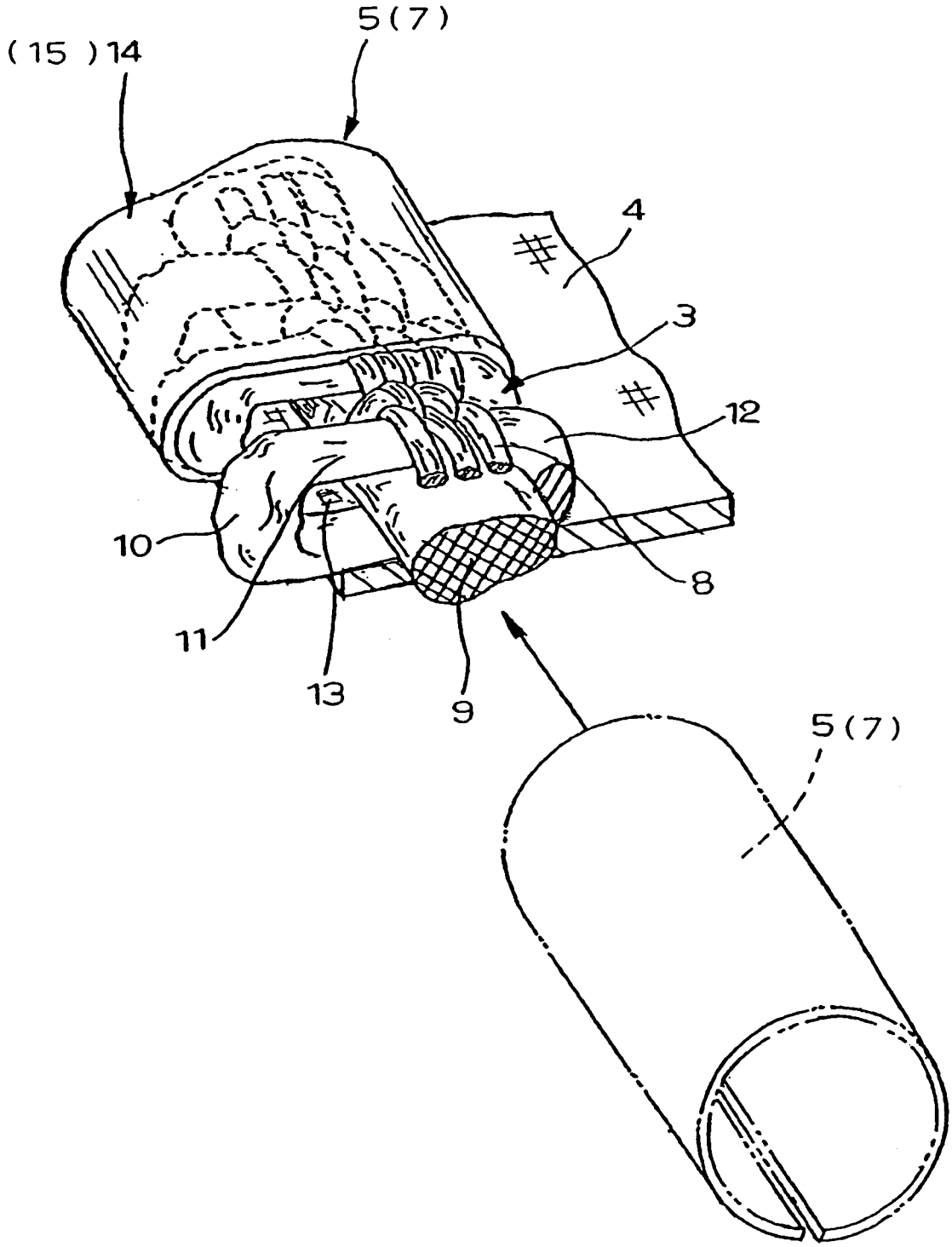
FIG. 11 is a perspective view of the top end stop using a sheet-like body for the ordinary type slide fastener.
Figure 12:
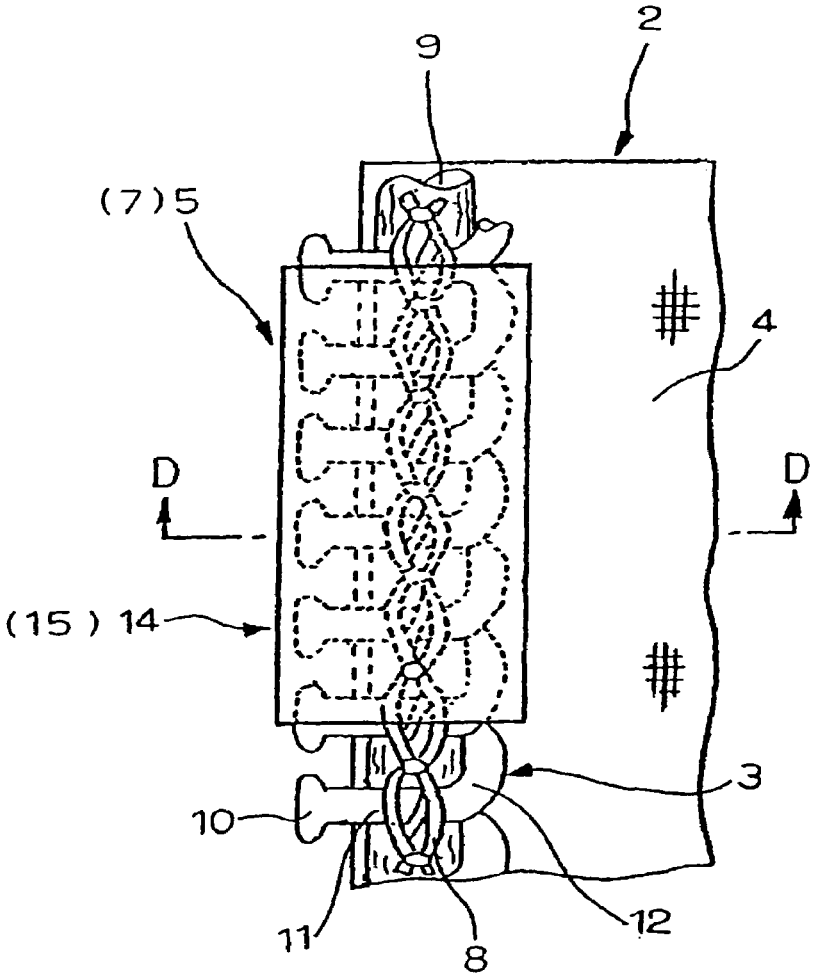
FIG. 12 is a front view of the same top end stop.
Figure 13:
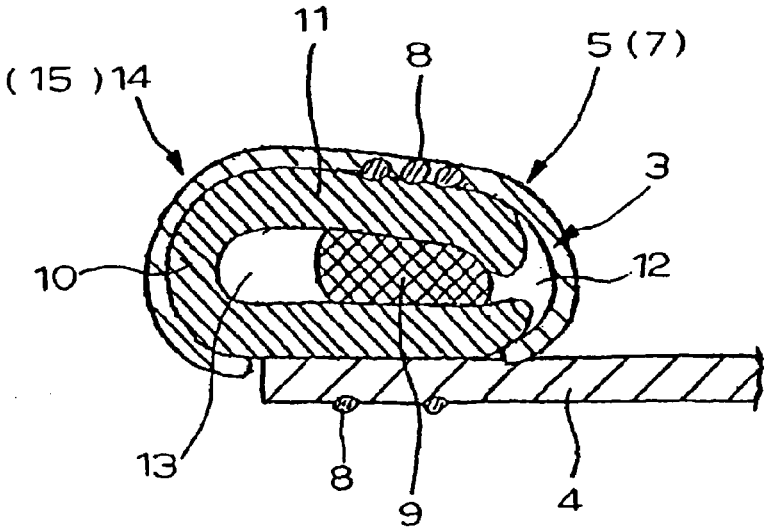
FIG. 13 is a sectional view taken along the line D—D of the same top end stop.

As for an end stop 14 as a top end stop 15 in an ordinary type slide fastener shown in FIGS. 11 to 13, an element, in which the core thread 9 is passed through the coil-like fastener element row 3, is sewed on the side edge of the fastener tape 4 such that the coupling heads 10 project from the side edge so as to produce the fastener stringer 2. A portion appearing on the fastener tape 4 in the plural fastener elements 3 existing at the terminal end of the fastener stringer 2, namely, the coupling heads 10, the leg portions 11 and the connecting portions 12 are surrounded and covered with the curved synthetic resin piece 5 and the synthetic resin piece 5 is attached to the portion with covering it, and thereafter, the synthetic resin piece 5 is fused with the fastener element row 3 by ultrasonic welding, so that the coupling heads 10 of the mating fastener elements 3 are blocked from invading into the coupling space portion 13 for their engagement, thereby forming the top end stop 15 which prevents the slider from slipping out. Further, by increasing the thickness of the synthetic resin piece 5, the synthetic resin piece 5 is made to contact with a guide post of the slider, thereby forming the tope end stop 15 which prevents the slider from slipping out.

Figure 14:
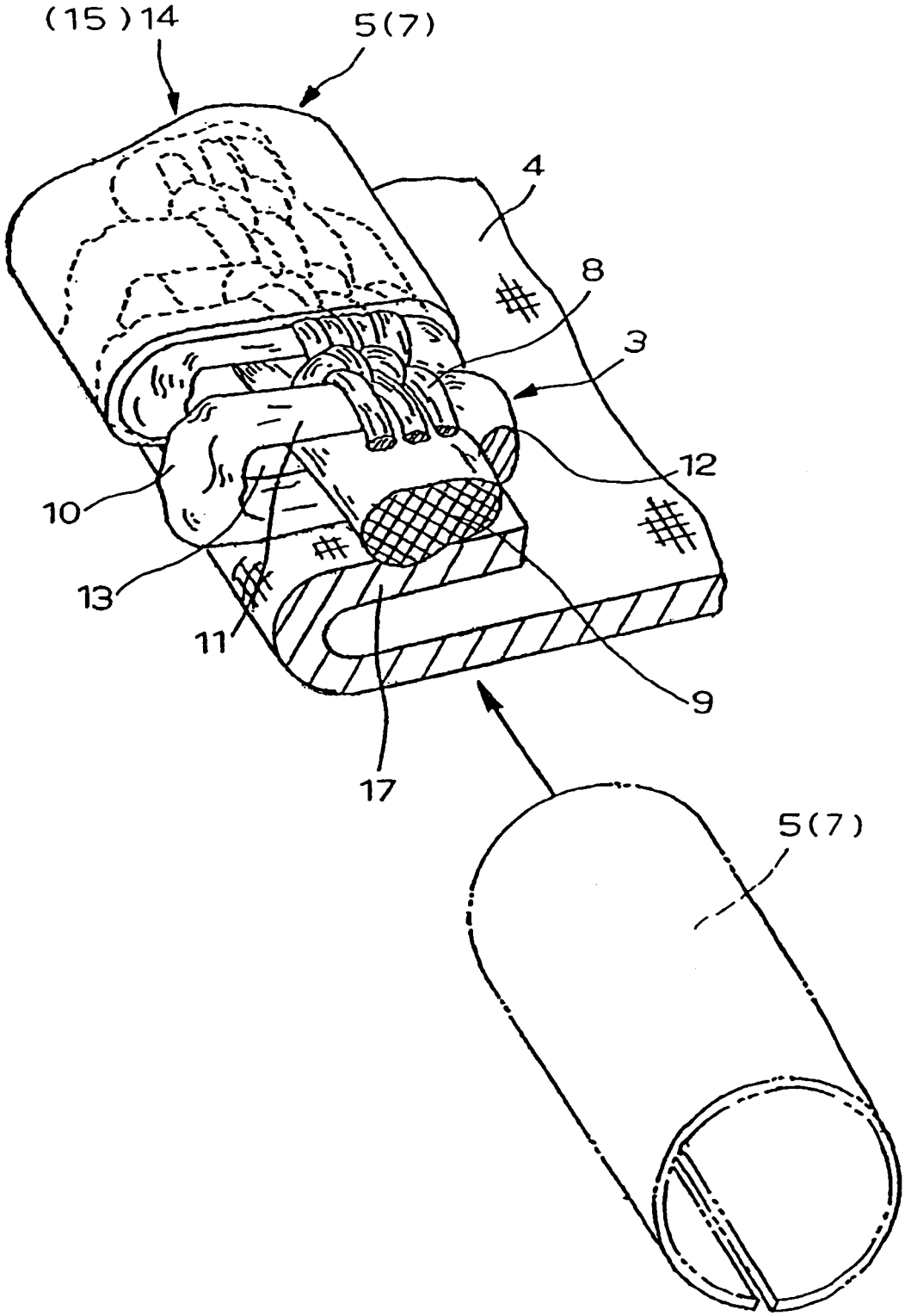
FIG. 14 is a perspective view of a top end stop using a sheet-like body for the hidden type slide fastener.
Figure 15:
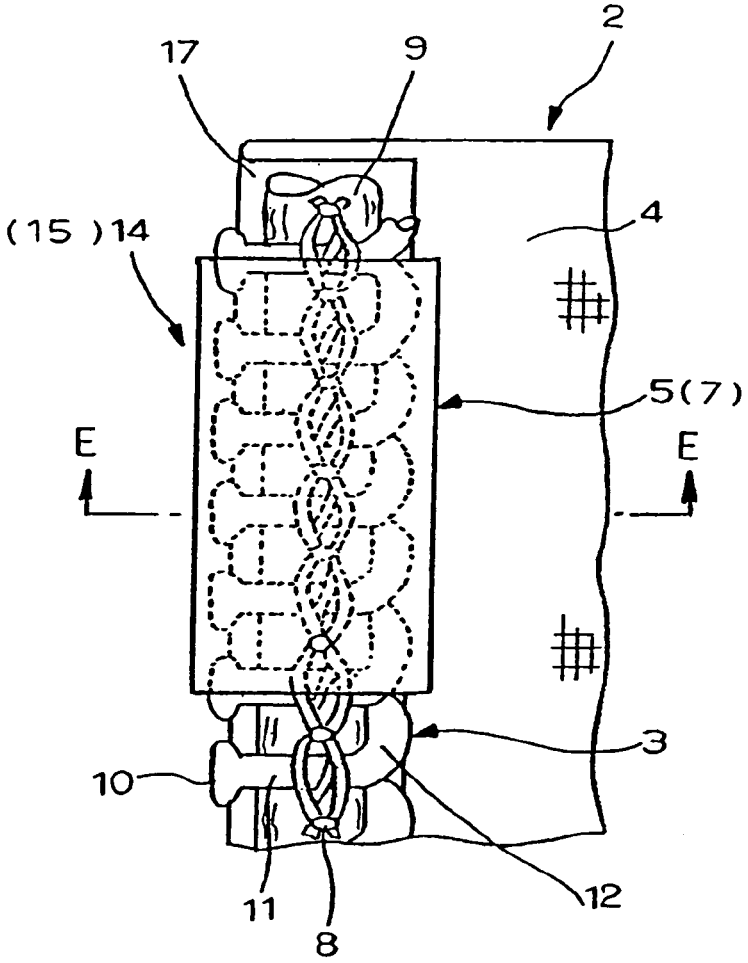
FIG. 15 is a front view of the same top end stop.
Figure 16:
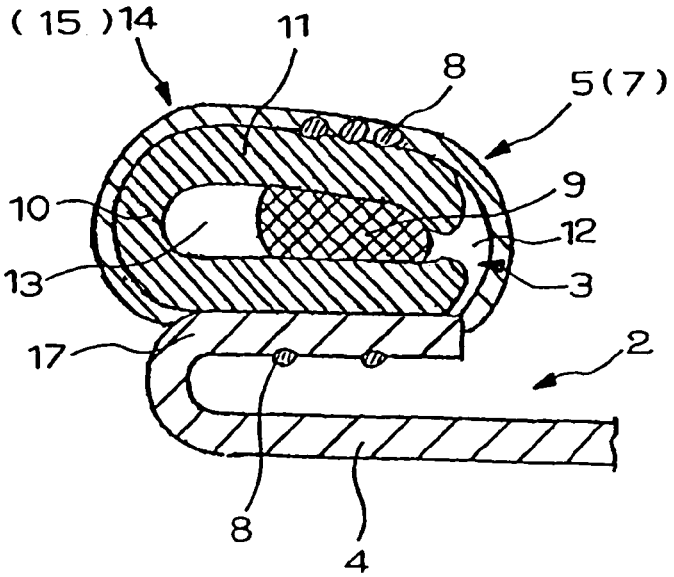
FIG. 16 is a sectional view taken along the line E—E of the same top end stop.

As for the end stop 14 as the top end stop 15 in the hidden type slide fastener shown in FIGS. 14 to 16, an element in which the core thread 9 is passed through the coil-like linear fastener element row 3 is sewed to the fastener tape 4 through the leg portions 11 such that the connecting portions 12 of the fastener elements 3 are located on the side edge of the fastener tape 4 and then, the fastener tape 4 is folded back near the sewing yarn 8 existing inside the fastener tape 4 such that the coupling heads 10 project from the folded-back portion 17 so as to produce the hidden type fastener stringer 2. Then, the appearing coupling head 10, the leg portions 11 and the connecting portions 12 in the plural fastener elements 3 existing at the terminal end of the fastener stringer 2 are surrounded and covered with the curved synthetic resin piece 5. After that, the synthetic resin piece 5 is fused with the fastener element row 3 by ultrasonic welding and fixed thereto so as to block the coupling heads 10 of the mating fastener elements 3 from invading into the coupling space portion 13 for their engagement, thereby forming the top end stop 15 which prevents the slider from slipping out. Further, by increasing the thickness of the synthetic resin piece 5, the synthetic resin piece 5 is made to contact with the guide post of the slider and the top end stop which prevents the slider from slipping out.

Figure 17:
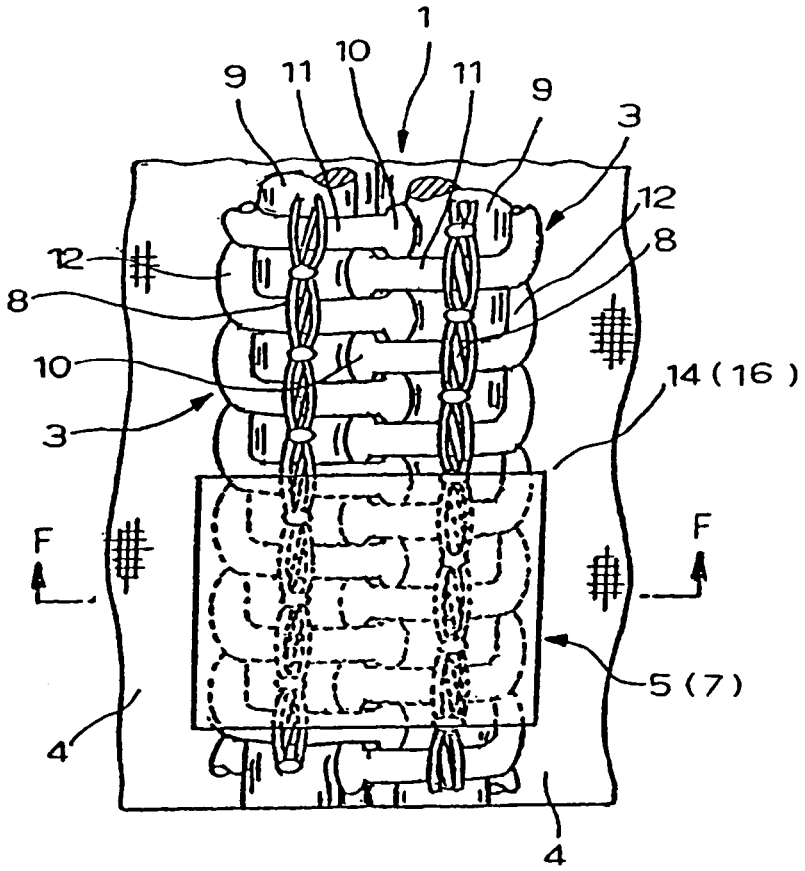
FIG. 17 is a front view of a bottom end stop using a sheet-like body for the ordinary type slide fastener.
Figure 18:
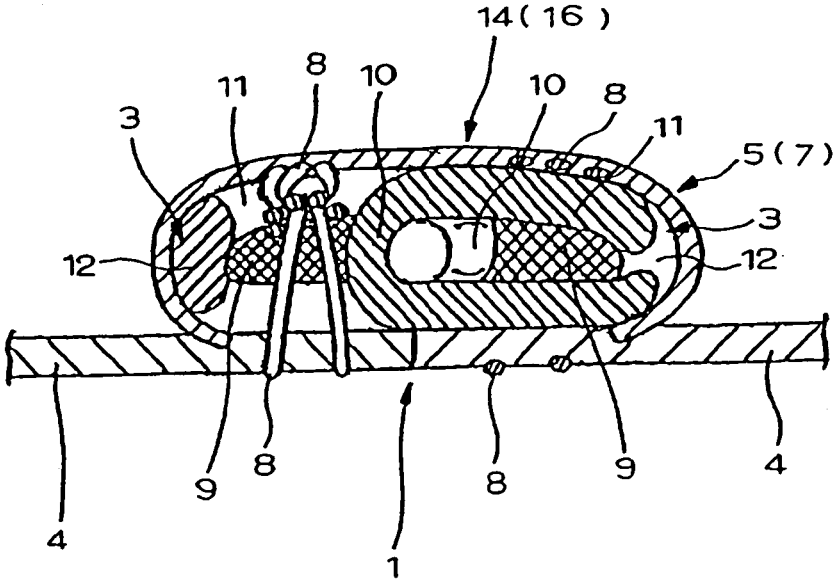
FIG. 18 is a sectional view taken along the line F—F of the same bottom end stop.

As for the end stop 14 in the ordinary type slide fastener shown in FIGS. 17 and 18, in the fastener chain in which the coil-like fastener element rows 3 mounted on the side edges of the right and left fastener tapes 4 are coupled with each other, the appearing coupling heads 10, the leg portions 11 and the connecting portions 12 of the plural fastener elements 3 at the terminal end of the fastener chain 1 are surrounded with the curved synthetic resin piece 5 and the synthetic resin piece 5 is attached thereto with covering them. After the attachment, the synthetic resin piece 5 is fused with the fastener elements 3 by ultrasonic welding and fixed thereto, whereby the end stop 14 is completed as the bottom end stop for the ordinary type slide fastener.

Figure 19:
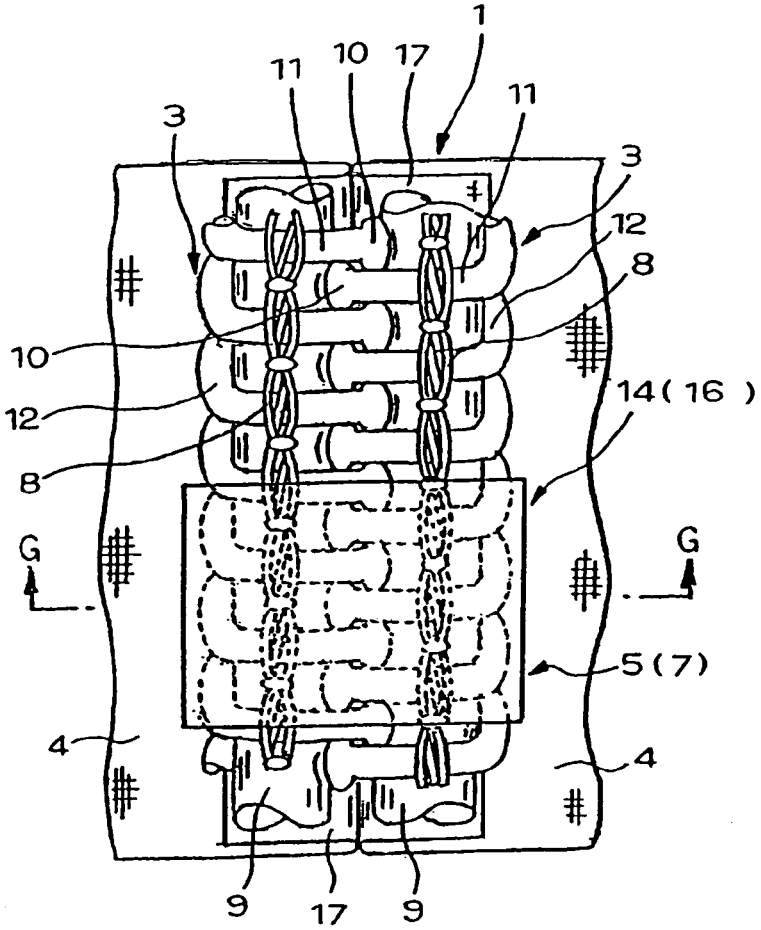
FIG. 19 is a front view of a bottom end stop using a sheet-like body for the hidden type slide fastener.
Figure 20:
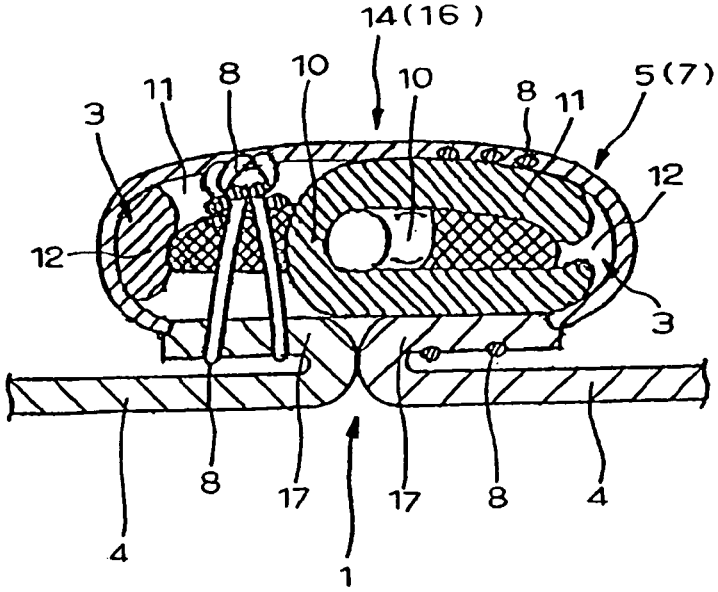
FIG. 20 is a sectional view taken along the line G—G of the same bottom end stop.

As for the end stop 14 in the hidden type slide fastener shown in FIGS. 19 and 20, in the fastener chain 1 in which the coil-like fastener element rows 3 mounted on the folded-back portions 17 of the right and left fastener tapes 4 are coupled with each other, the appearing coupling heads 10, the leg portions 11 and the connecting portions 12 of the plural fastener elements 3 on the terminal end of the fastener chain 1 are surrounded with the curved synthetic resin piece 5 and the synthetic resin piece 5 is attached thereto with covering them. After the attachment, the synthetic resin piece 5 is fused with the fastener elements 3 by ultrasonic welding and fixed thereto so as to complete the end stop 14 as the bottom end stop for the hidden type slide fastener.

In the meantime, according to the present invention, the end stops 14 as the top end stop 15 and bottom end stop 16 of a rigid ordinary type slide fastener and hidden type slide fastener may be formed by inserting the rod-like body 6 of the synthetic resin piece 5 into the coupling space portion 13 of the linear fastener element row 3 and attaching the rod-like body 6 to the coupling space portion 13 and by covering the surface of the linear fastener element row 3 with the sheet-like body 7 of the synthetic resin piece 5 and then attaching the synthetic resin piece to the linear fastener element row 3, that is, it is possible to use the rod-like body 6 and the sheet-like body 7 at the same time and fuse the rod-like body 6 and the sheet-like body 7 with the linear fastener element row 3 by ultrasonic welding.

Figure 21:
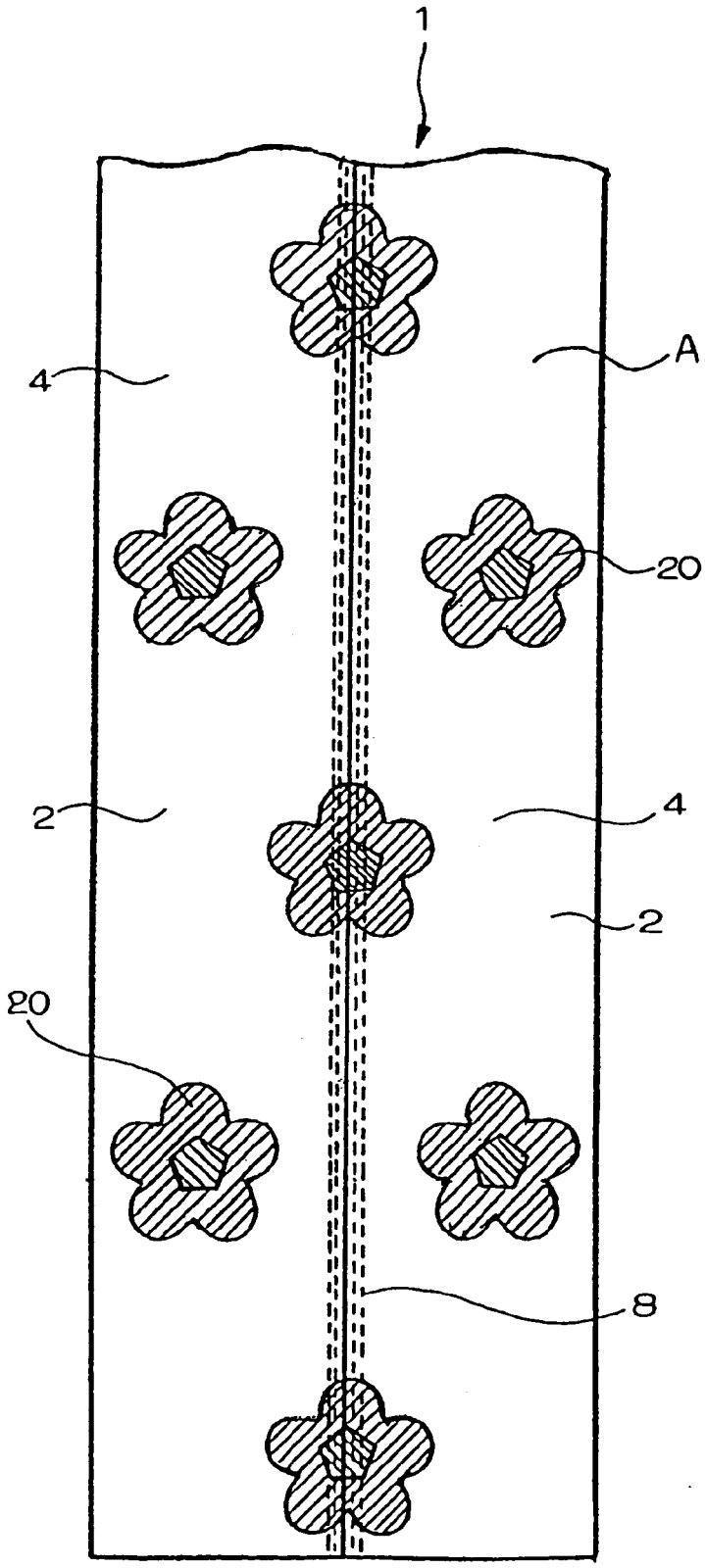
FIG. 21 is a front view of a fastener chain whose surface is printed with patterns by an ink jet.

Finally, the embodiment of the slide fastener shown in FIGS. 21 and 25 will be described. The slide fastener shown here is an ordinary type slide fastener and various kinds of patterns, characters and the like are represented on the fastener tapes 4 located at the surface side A of the fastener chain 1 by ink jet as a special processing or waterproof processing is performed to the fastener tapes 4. The core thread 9 is attached to the synthetic resin coil-like or zigzag-like linear fastener element row 3, and the linear fastener element row 3 is sewed with the sewing yarn 8 on the fastener tape 4 located at the rear surface side B of the fastener chain 1 and attached to the edge portion of the tape so as to complete the fastener chain 1.

Figure 22:
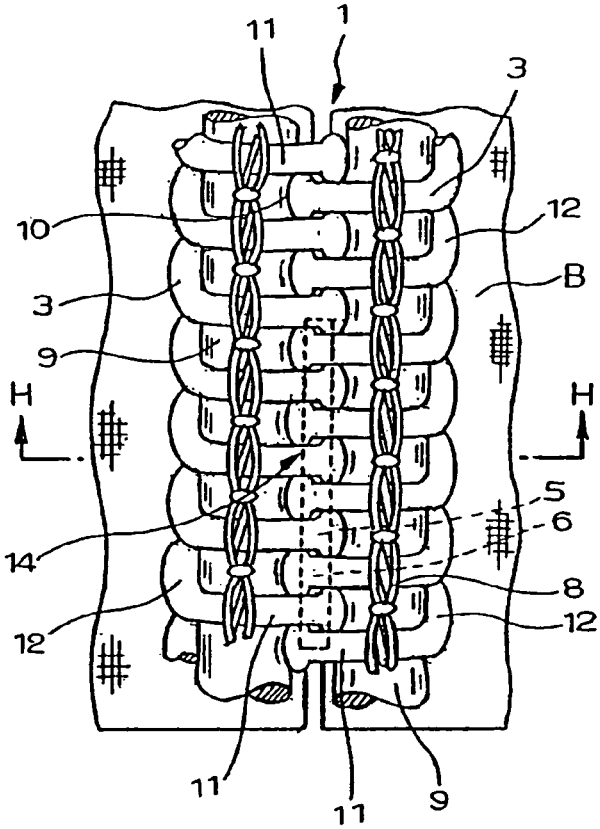
FIG. 22 is a front view of an end stop formed from a bar-like body on the rear face of the same fastener chain.
Figure 23:
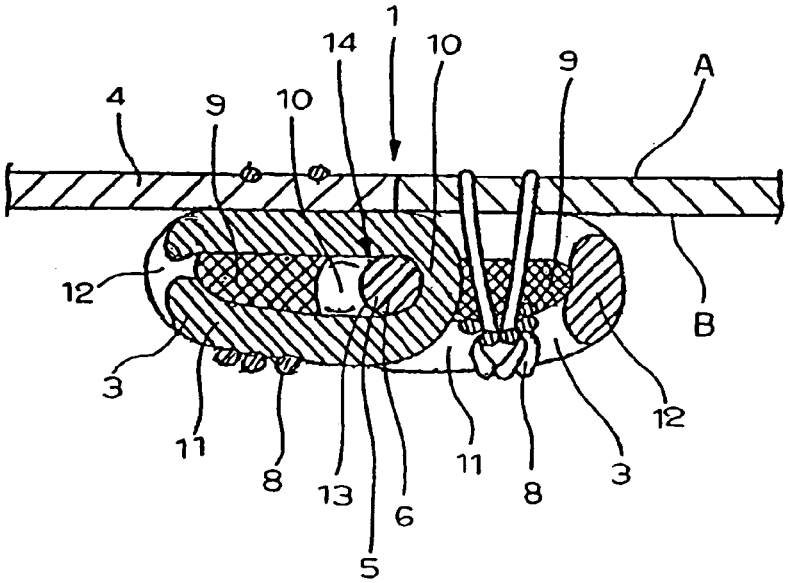
FIG. 23 is a sectional view taken along the line H—H of the same fastener chain.

In the fastener chain 1 shown in FIGS. 22 and 23, the rod-like body 6 as the synthetic resin piece 5 is inserted into the coupling space portion 13 existing in the rear side of the coupling heads 10 of the plural fastener elements 3 on both sides located at the terminal end side of coupled fastener element rows 3 disposed on the rear surface side B and the rod-like body 6 is attached thereto. After the attachment, the rod-like body 6 is fused by ultrasonic welding and fixed to the coupling space portion 13 so as to produce the end stop 14 as the bottom end stop 16. This type of the end stop 14 is also applicable for the top end stop 15 at the upper terminal end of the fastener stringer 2.

Figure 24:
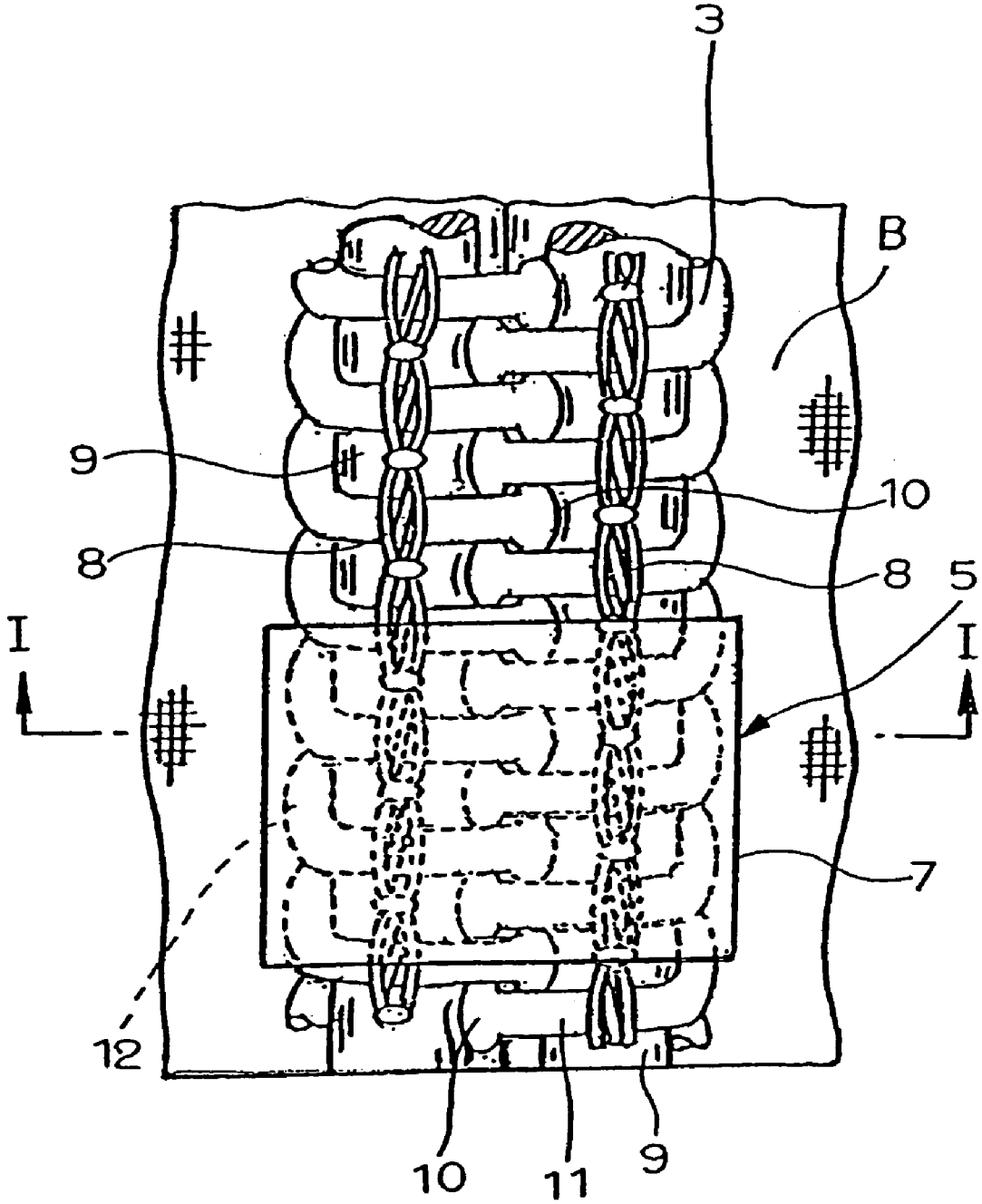
FIG. 24 is a front view of an end stop formed from a sheet-like body on the rear face of the fastener chain shown in FIG. 21.
Figure 25:
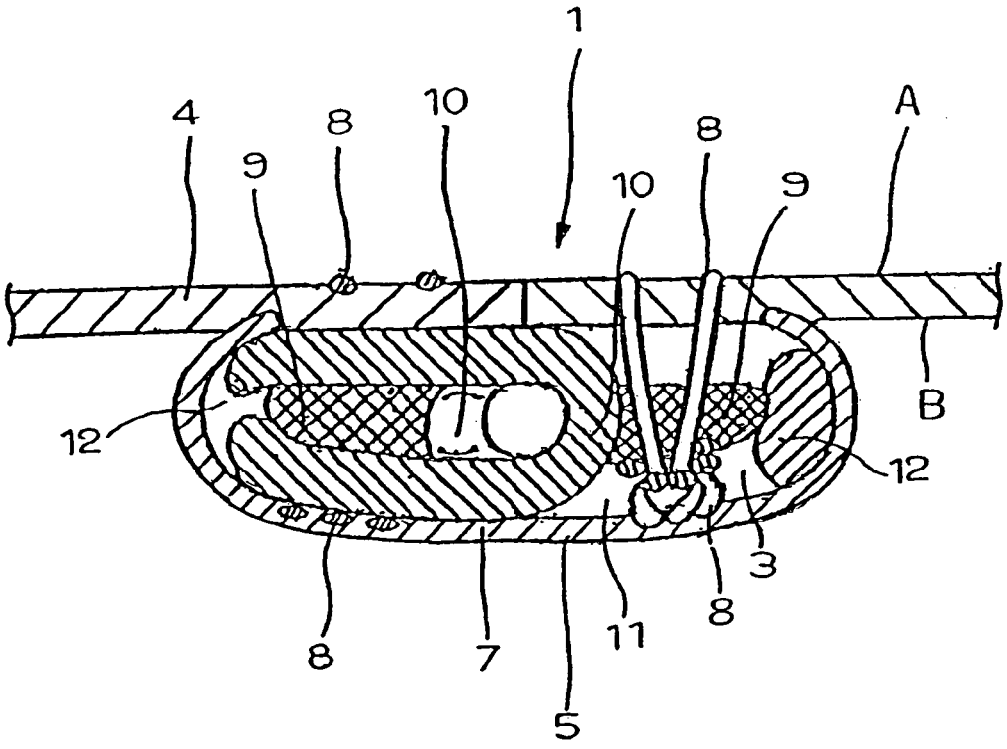
FIG. 25 is a sectional view taken along the line I—I of the same fastener chain.
Figure 26:
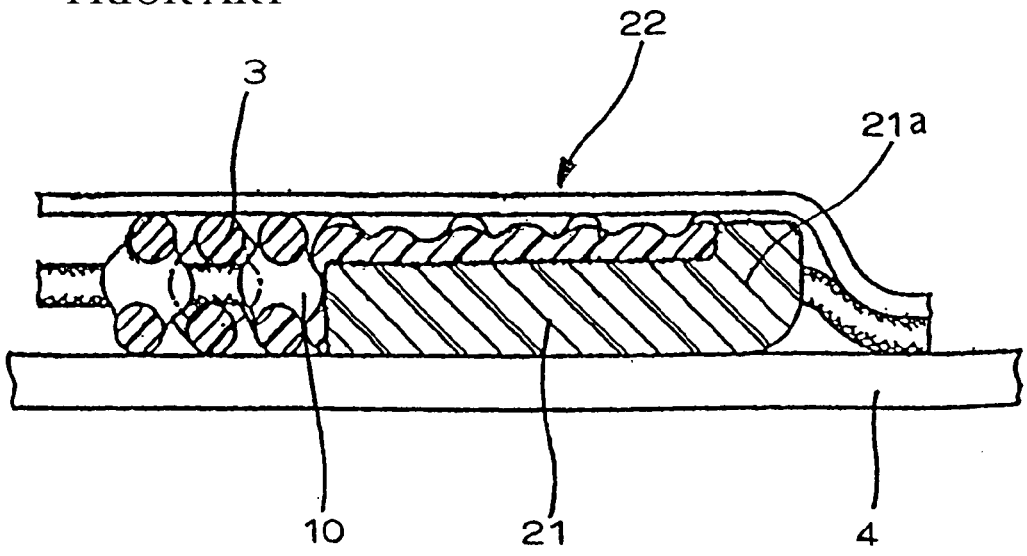
FIG. 26 PRIOR ART
FIG. 26 is a sectional view of a well known bottom end stop.
Figure 27:
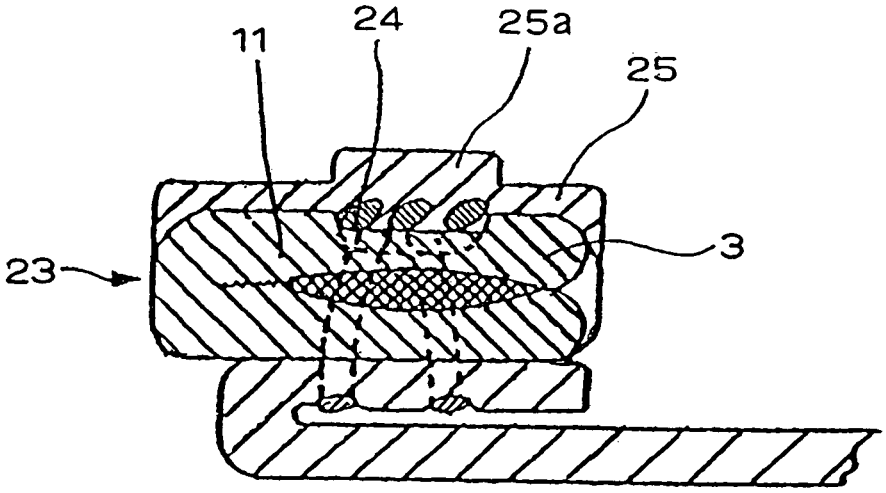
FIG. 27 PRIOR ART
FIG. 27 is a sectional view of a well known top end stop.
Figure 28:
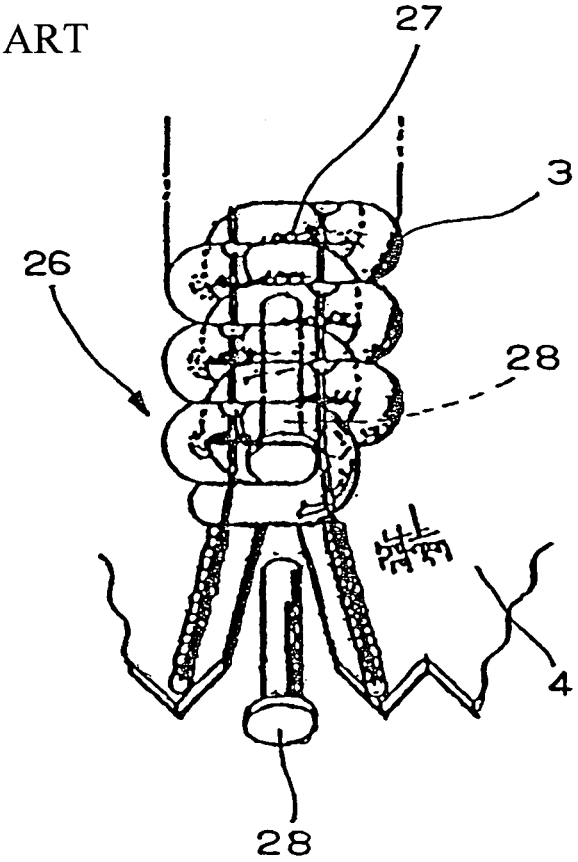
FIG. 28 PRIOR ART
FIG. 28 is a perspective view of another well known bottom end stop.

As shown in FIGS. 24 and 25, the coupling heads 10, the leg portions 11 and the connecting portions 12, which appear on the fastener tape 4, of the plural fastener elements 3 existing at the terminal end of coupled fastener element rows 3 disposed on the rear surface side B of the fastener chain 1 are surrounded with the curved sheet-like body 7 of the synthetic resin piece 5 and the curved sheet-like body 7 is attached thereto with covering them. After the attachment, this sheet-like body 7 is fused with and fixed on the fastener element row 3 by ultrasonic welding so as to produce the end stop 14 as the bottom end stop 16. This type of the end stop 14 is also applicable to the top end stop 15 at the upper terminal end of the fastener stringer 2.

The fastener chain 1 having the above-described end stop 14 can be finished as a fastener chain 1 having a very excellent appearance because no trace indicating an existence of the end stop 14 appears on the fastener tapes 4 on the surface side A. Meanwhile, the fastener chain 1 which undergoes the special treatment at its fastener tapes 4 is applicable to the hidden type fastener chain 1 as well as the ordinary type, and as a result, an excellent appearance hidden type slide fastener can be completed.

The invention claimed is:

1. An end stop for a slide fastener, wherein the end stop is formed by fusing a rod-like body, which is a synthetic resin piece, attached over a coupling space surrounded by a linear fastener element row and a core thread on a rear side of coupling heads of plural fastener elements located at a terminal end of the linear fastener element row made of synthetic resin and mounted on a side edge of a fastener tape.

2. The end stop for the slide fastener according to claim 1, wherein the synthetic resin is composed of a curved sheet-like body.

3. The end stop for the slide fastener according to claim 2, wherein the sheet-like body covers surfaces of coupling heads, leg portions and connection portions in the linear fastener element row and is fused.

4. The end stop for the slide fastener according to claim 1, wherein the rod-like body is crushed from front and rear surfaces together with the coupling heads in the linear fastener element row and fused.

5. The end stop for the slide fastener according to claim 1, wherein the rod-like body is disposed inside linear fastener element rows in a non-coupled state and fused so as to form a top end stop.

6. The end stop for the slide fastener according to any one of claims 2 and 3, wherein the sheet-like body is disposed of surfaces of linear fastener element rows in a non-engaged state and fused so as to form a top end stop.

7. The end stop for the slide fastener according to claim 1, wherein the rod-like body is disposed inside linear fastener element rows in a coupled state and fused so as to form a bottom end stop.

8. The end stop for the slide fastener according to any one of claims 2 and 3, wherein the sheet-like body is disposed on surfaces of the linear fastener element rows in a coupled state and fused so as to form a bottom end stop.

9. A slide fastener, wherein a pattern formed by ink jet is represented on a fastener tape, and/or waterproof processing performed to the fastener tape on a surface side of a fastener chain having an end stop formed by fusing a rod-like body, which is a synthetic resin piece attached over a coupling space surrounded by a linear fastener element row and a core thread on a rear side of coupling heads of plural fastener elements located at a terminal end of the linear fastener element row made of synthetic resin and mounted on a side edge of the fastener tape.

* * * * *